US006708621B1

(12) United States Patent
Forichon-Chaumet et al.

(10) Patent No.: US 6,708,621 B1
(45) Date of Patent: Mar. 23, 2004

(54) IGNITING DEVICE FOR A PROPELLANT CHARGE

(75) Inventors: Nicole Forichon-Chaumet, Plaimpied (FR); Patrick Berneau, Bourges (FR); Laurent Desgland, Les Aix d'Angillon (FR)

(73) Assignee: Giat Industries (FR)

( * ) Notice: Subject to any disclaimer, the term of this patent is extended or adjusted under 35 U.S.C. 154(b) by 103 days.

(21) Appl. No.: 09/689,665

(22) Filed: Oct. 13, 2000

(30) Foreign Application Priority Data

Oct. 13, 1999 (FR) ..... 99 12860

(51) Int. Cl.[7] ..... F42B 5/00
(52) U.S. Cl. ..... 102/470; 102/430; 102/202
(58) Field of Search ..... 102/430–433, 102/439, 467, 469, 470, 700, 202

(56) References Cited

U.S. PATENT DOCUMENTS

| | | | | | |
|---|---|---|---|---|---|
| 3,696,749 | A | * | 10/1972 | Scanlon | 102/49.7 |
| 3,955,506 | A | * | 5/1976 | Luther et al. | 102/43 P |
| 4,763,577 | A | * | 8/1988 | Romer et al. | 102/431 |
| 4,917,017 | A | * | 4/1990 | Beltz | 102/470 |
| H940 | H | * | 8/1991 | Roller | 102/430 |
| 5,052,302 | A | * | 10/1991 | Taddeo et al. | 102/204 |
| 5,129,324 | A | * | 7/1992 | Campoil | 102/430 |
| 5,179,250 | A | * | 1/1993 | Campoli | 102/443 |
| 5,183,961 | A | * | 2/1993 | Campoli et al. | 102/439 |
| 5,241,909 | A | * | 9/1993 | Eches et al. | 102/202 |
| 5,325,785 | A | * | 7/1994 | Gardener | 102/430 |
| 5,465,665 | A | * | 11/1995 | Diehl | 102/470 |
| 6,131,519 | A | * | 10/2000 | Thiesen et al. | 102/469 |

FOREIGN PATENT DOCUMENTS

| | | | |
|---|---|---|---|
| DE | 19751933 | * 6/1999 | 102/469 |
| FR | 2 343 987 | * 11/1977 | |
| FR | 2 593 905 | 2/1986 | |
| WO | WO 91/05981 | 5/1991 | |

* cited by examiner

*Primary Examiner*—Jack Keith
(74) *Attorney, Agent, or Firm*—Parkhurst & Wendel, L.L.P.

(57) ABSTRACT

An ignition device for a propellant charge contained in a cylindrical case of a munition, said device comprising at least one linear energetic element and means to ignite said element, and characterised in that the ignition means comprise a tubular part, placed at a bottom cap part of the case and delimiting a chamber that communicates with a pyrotechnic igniting component, said tubular part comprising an axial hole intended to allow the passage and entry into the chamber of the linear igniting element or elements arranged substantially along the case axis.

6 Claims, 2 Drawing Sheets

IGNITING DEVICE FOR A PROPELLANT CHARGE

BACKGROUND OF THE INVENTION

1. Field of Invention

The technical scope of the invention is that of igniting devices for a propellant charge contained within a cylindrical case of a piece of ammunition.

The invention is more particularly aimed at igniting devices implementing at least one linear energetic igniting element, such as a detonating cord.

2. Description of Related Art

Such igniting devices are known, notably by patents U.S. Pat. No. 5,325,785 and U.S. Pat. No. 5,129,324.

In making cased munitions of whatever calibre conventional priming tubes (such as those described for example in patent FR2593905) are tending to be replaced by linear energetic elements. These elements allow ignition to be optimised for modern munitions that are of substantial length and/or a volume of powder that is difficult for the flame of a conventional primer to reach, such as that arranged, for example, around the tail piece of a projectile.

These energetic elements are connected to a common ignition means and they enable the multi-point ignition of the propellant charge.

These elements are made, for example, in the shape of wires, films, strands, cords. They comprise, for example, a pyrotechnic composition, such a black powder or a composition combining boron with potassium nitrate or else aluminium and potassium perchlorate, or magnesium/polytetrafluorethylene/copolymer of chlorofluoroethylene (magnesium/Teflon (trade mark)/Viton (trade mark).

The composition is packaged in a support made, for example, of a tube of plastic material.

The energetic elements can also comprise one or several secondary explosives (cyclonite, homocylconite) made integral with a support.

According to the energetic material used, the ignition will be propagated more or less quickly (reaction of combustion, deflagration or detonation) and the radial effectiveness of the ignition ensured by the energetic element will also be more or less good.

According to the munition, the energetic elements are fastened to the inner surface of the, case or to a rear part of the projectile.

With such ignition devices there is the problem of setting them into place inside the munition case and notably that of making the different energetic elements integral with a common ignition means, for example an axial primer fastened to a base of a munition case.

Indeed, in traditional munitions, the propellant charge is generally arranged in the case before the primer tube is set into position. The latter is introduced last via an axial hole in the base and is fastened simply by screwing. Such a solution is not adapted to an ignition device that incorporates different elements evenly spaced inside the case.

To overcome this problem, patent U.S. Pat. No. 5,325,785 proposes the provision of a detonating cord support that caps the rear of the projectile and onto which an ignition support is screwed.

Such a solution, nevertheless, has certain drawbacks.

First of all the cord support is a part that encompasses the rear of the projectile at its tail end. This part is complicated in shape, and incorporates longitudinal grooves receiving the cords and other grooves co-operating with the tail fins.

It is not easy to set this part into position, notably when the cords are integral with the inner surface of the case.

Such a solution may be only adopted when the tail piece of the projectile is very close to the base of the case. Moreover, such a holding part that is integral with the projectile runs the risk of perturbing its ballistic performances.

SUMMARY OF THE INVENTION

The aim of the invention is to propose an ignition device that does not suffer from such drawbacks.

The ignition device proposed by the invention is both simple and inexpensive and facilitates the operations of loading the powder and assembling the case.

It can be easily adapted to any type of munition whatever the length of the, projectile, with or without tail fins.

Thus, the subject of the invention is an ignition device for a propellant charge contained in a cylindrical case of a munition, said device comprising at least one linear energetic element and means to ignite said element, and characterised in that the ignition means comprise a tubular part, placed at a bottom cap part of the case and delimiting a chamber that communicates with a pyrotechnic igniting component, said tubular part comprising an axial hole intended to allow the passage and entry into the chamber of the linear igniting element or elements arranged substantially along the case axis.

The ignition device according to the invention can incorporate at least two linear energetic ignition elements, said elements being connected along at least part of their length so as to form a strand that is placed substantially along the case axis and penetrates into the chamber of the tubular part through the axial hole.

The chamber can enclose at least one ring-shaped ignition relay.

The axial hole of the tubular part can have a diameter that is substantially the same as that of the strand.

Advantageously, the strand can be of a length greater than or equal to 50 mm.

The strand can penetrate into the tubular part over a length of at least 15 mm.

The energetic linear ignition element or elements can be fastened at a rear part of a projectile placed in the case.

The energetic linear ignition elements can alternatively be fastened onto an inner cylindrical surface of the case.

The tubular part can be made of a combustible and/or energetic material.

The ignition means can comprise an igniter unit onto which the tubular part will be fastened, said igniter unit comprising a pyrotechnic igniting component, such a squib, and at least one ignition relay.

The tubular part can be integral with a cup that obturates the bottom of the case and that is made integral with a cylindrical wall of the case by fastening means.

BRIEF DESCRIPTION OF THE DRAWINGS

The invention will be better understood after reading the following description of the different embodiments, such description being made with reference to the appended drawings, in which.

DETAILED DESCRIPTION OF PREFERRED EMBODIMENTS

Figure 1:
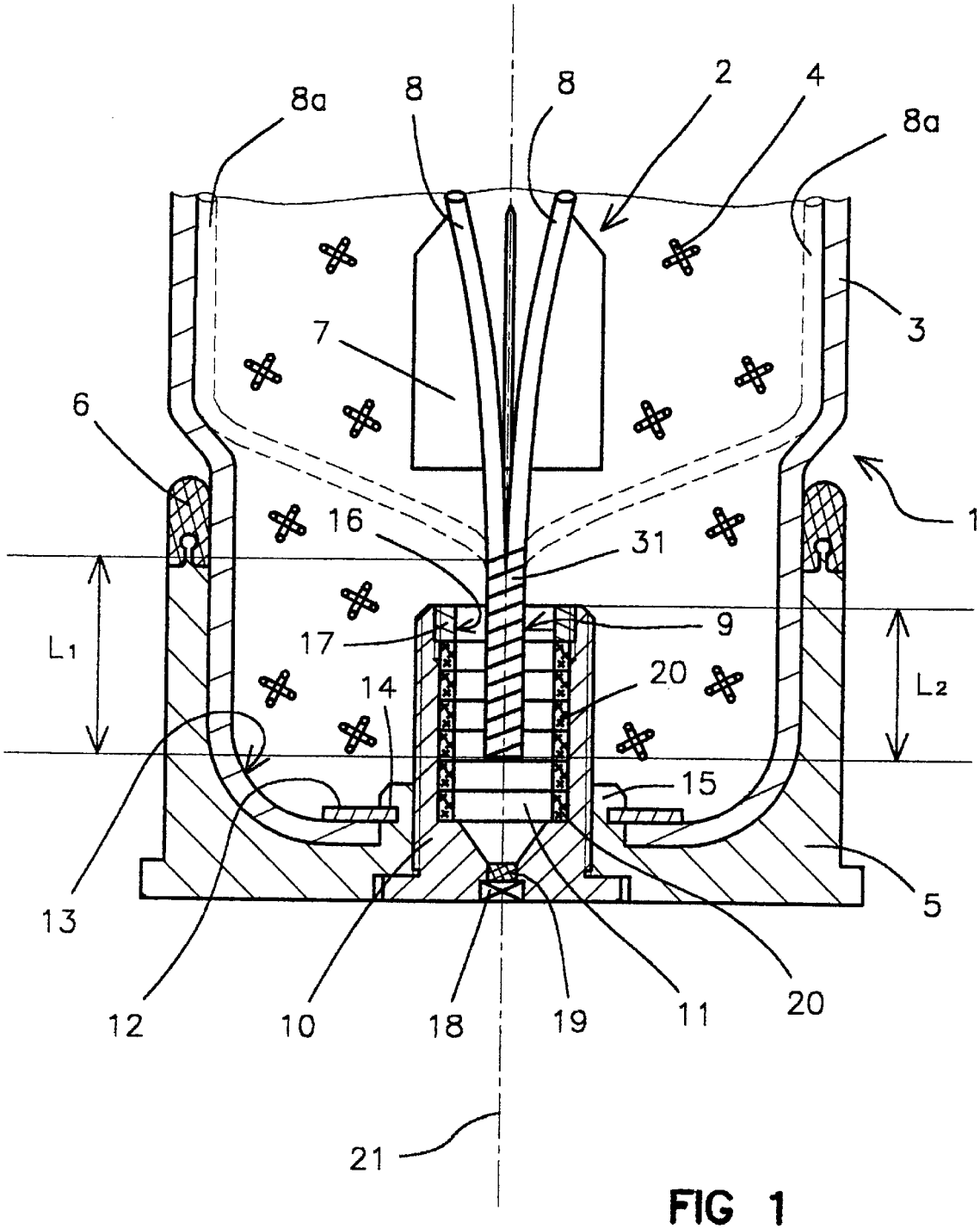
FIG. 1 show a longitudinal section of the base and rear part of the case of a large calibre munition fitted with an ignition device according to a first embodiment of the invention.

With reference to FIG. 1, a munition 1, for example of large calibre (over 90 mm) for a tank cannon, comprises a projectile 2 placed inside a case 3 made of a combustible material, for example in nitrocellulose impregnated cardboard.

The case encloses a propellant charge 4 in the form of a propellant power in grains and is closed at its rear part by a metallic base 5 fitted with a rubber sealing lip 6.

The case 3 has a cup-shaped bottom 13 that matches the inner surface of the base 5. Said base is fastened to the case 3 by means of a spring washer 12 housed in a groove 14 in an axial extension 15 of the base 5.

Only the rear part of the projectile 2 is shown here and this schematically. The projectile carries a tail piece 7 and is of a length such that the tail piece 7 lies in proximity to the base 5 (around 150 mm).

The ignition device for the propellant charge 5 here incorporates three linear energetic ignition elements 8.

These elements are, for example, detonating cords loaded with a pyrotechnic composition. Such elements are well known to the expert and do not form the subject of the present invention, they will therefore not be described in any further detail.

Such as is shown here, the cords can be fastened to the rear part of the projectile 2, for example by bonding or by linking with adhesive tape.

The cords can alternatively be bonded to the inner cylindrical surface of the combustible case 3 (cords 8*a* shown in dashes).

In any event and in accordance with the invention, the cords will be connected together on at least part of their length so as to form a strand 9 that is arranged substantially along the axis 21 of the case 3.

This connection will be ensured, for example, by means of adhesive tape 31 or a collar.

The length L1 of the strand will preferably be greater than 50 mm thereby giving a certain rigidity to the strand and allowing its rear end to be brought near the case bottom.

In the event that the implementation of a single cord is preferred (for example, a cord bonded and wound into a spiral on the inner cylindrical surface of the case 3), a certain length L of the end of the cord must be made to lie substantially along the case axis, and this in an analogous manner to the strand shown in FIG. 1.

The cords will be selected so as to have sufficient rigidity to ensure the strand 9 (or else the cord alone) is held along the axis 21.

If there is not enough rigidity for this, a brace or shim in cardboard (not shown) can be provided that will position the end of the cord or strand along the axis 21. This shim will be open-worked so as not to hinder the positioning of the powder.

In accordance with the invention, the ignition means comprise a metal tubular part 10 that is placed at the bottom 13 of the case. In practical terms, this part 10 is fastened to the base 5 by threading. It delimits a cylindrical chamber 11 inside which the strand 9 (or the end of the cord is only one cord is implemented) penetrates.

So as to allow the passage of the strand 9, the tubular part 10 comprises an axial hole 16. This hole is, in this case, carried on a cover 17, fastened to the tubular part by threading.

The strand 9 penetrates into the tubular part over a length L2 of at least 15 mm. This ensures that there is a length of cord in the chamber that is enough to ensure the reliable and reproducible ignition of all the cords. Moreover, such an arrangement avoids the strand slipping out of the chamber further to the vibrations caused by transporting and implementing the munition.

The chamber 11 communicates with an ignition pyrotechnic component 18 that is a primer of a known type, that can be electrically ignited or ignited by percussion.

A pyrotechnic relay squib 19 is, in this case, placed between the, primer 18 and the strand 9.

According to the embodiment shown in this figure, the chamber also encloses ring-shaped tablets 20 of a compressed priming relay pyrotechnic composition. Compressed black powder can be used, for example, or else a classical pyrotechnic composition (for example combining aluminium and copper oxide or boron and potassium nitrate). The compressed tablets 20 are held axially in the tubular part 10 by the screwed on cap 17.

The relays 19 and 20 will, for example, be formed of a composition such as: black powder, aluminium (20% in mass)/copper oxide (CuO 80% in mass), boron (20% in mass)/potassium nitrate (KNO3 80% in mass).

The munition 1 will be assembled as follows:

First of all the case 3 will be joined to the base 5 that is not carrying the tubular part 10.

Depending on the case, the cords 8*a* are fastened to the inner surface of the case 3, or else the cords 8 are fastened onto the projectile 2. During this process, the ends of the cords are joined so as to form the strand 9.

The projectile is fastened to the case using suitable means, for example a linking ring such as that described in EP307307.

Loading with propellant powder is lastly carried out by introducing the grains of powder through the axial opening in the base 5.

When this operation is completed, the tubular part 10 is set into placed and screwed onto the base 5.

Because the strand (or single cord) is positioned at the axis 21, screwing the tubular part 10 into place ensures the introduction of the strand 9 into the chamber 11 delimited by the tubular part.

The diameter of the hole 16 will be selected greater than that of the strand (hole diameter of 4 to 20 mm according to the number of cords) so as to facilitate the positioning of the tubular part. We can see that thanks to the invention a certain latitude is permitted regarding the positioning of the strand with respect to the case axis 21 as well as the length of strand penetrating into he chamber 11. This allows a given ignition device to be easily assembled and adapted to different types of munitions.

Moreover, making the strand using adhesive tape is quick and easy and does not require a mechanical part to be fastened to the projectile at the risk of perturbing its flight.

By way of a variant, it is possible to vary the number of relay priming tablets 20 arranged in the chamber 11. It is also possible for none to be provided.

The fastening means can also be different. The tubular part can be bonded, crimped or bayonet fitted. It can be made out of one or more parts.

Figure 2:
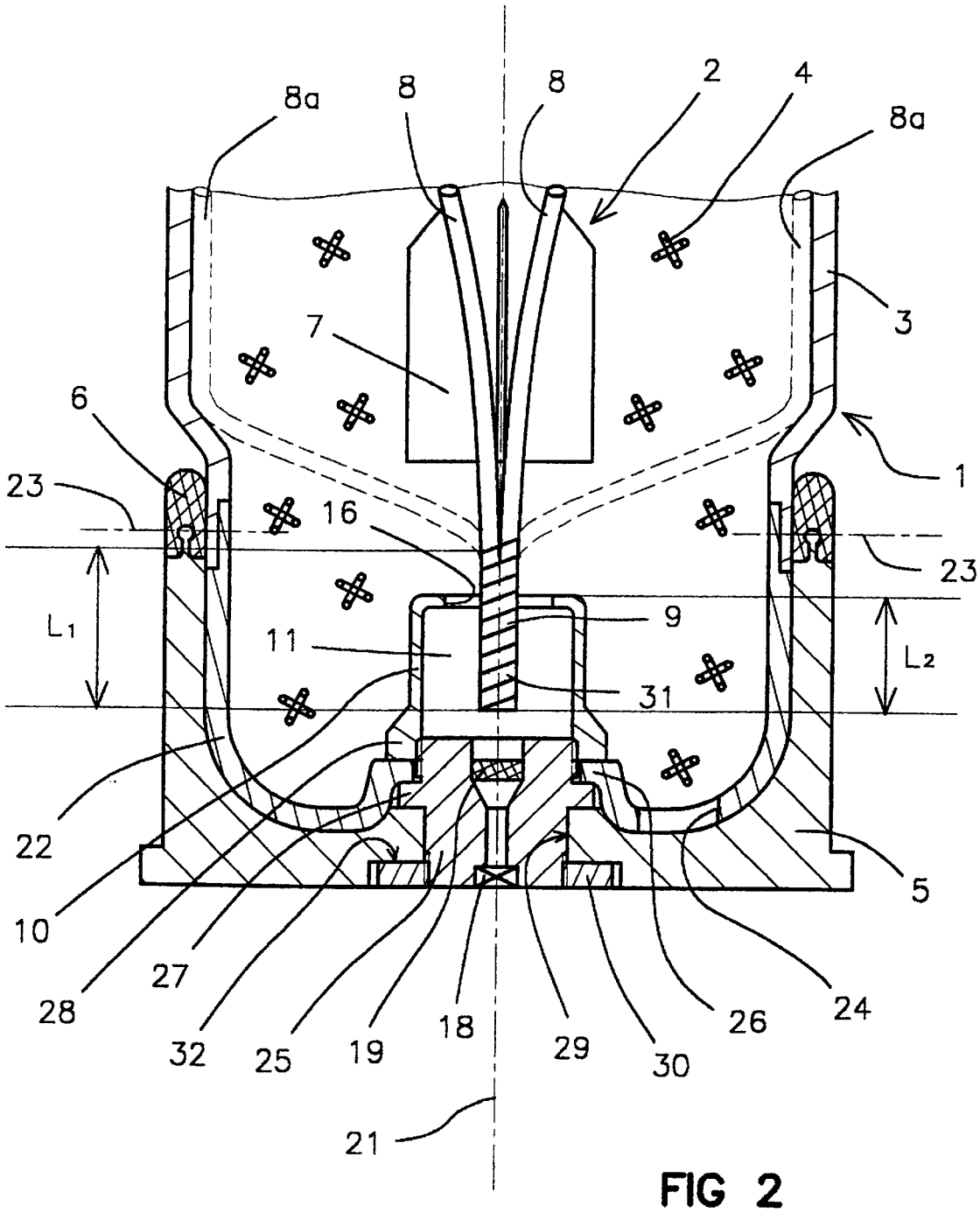
FIG. 2 shows a longitudinal section of the base and rear part of the case of a large calibre munition fitted with an ignition device according to a second embodiment of the invention.

FIG. 2 shows another embodiment of a device according to the invention.

This embodiment differs from the previous one essentially in the shape of the tubular part 10 and in the structure of the mode of linking the base 5 to the case 3.

According to this mode, the closing bottom of the case is constituted by a cup 22, made, for example, of a plastic material such as polyamide. This cup is made integral with the case 3 by fastening means which are here rivets, evenly spaced angularly (rivets shown only by their axes 23). This cup 22 has a lateral opening 24 intended to allow the case to be filled with grains of propellant powder 4.

The cup 22 also carried the tubular part 10 screwed to an ignition unit 25. Thus, the cup 22 incorporates a central collar 26 pinched between a rib 27 of the ignition unit 25 and a ring-shaped support 28 of the tubular part 10.

The base 5 is fastened to the case after it has been filled with powder. It comprises a smooth axial bore 29 adjusted onto a rear cylindrical extension of the ignition unit. The base 5 abuts against the rib 27 of the ignition unit and is immobilised by a nut 30 screwed onto a threaded part of the rear extension of the ignition unit.

The nut 30 is fully housed in a counter-sink 32 in the base 5. It incorporates holes (not shown) that enable it to be screwed in place using a claw wrench of a known type.

As in the previous embodiment, the tubular part 10 delimits a chamber 11 accommodating the strand 9.

The ignition unit 25 carries a primer 18 and a pyrotechnic relay 19.

There are no relay charge tablets placed in the chamber 11. But of course it is quite possible, as in the previous embodiment, and according to the properties of a given munition, to place such tablets in this chamber.

The tubular part 10 can be made of metal or of a plastic material.

As in this embodiment it does not ensure a sealing function with respect to the gases generated by the propellant charge, it can also be advantageously made of a combustible or energetic material, for example a composition combining an oxidant (nitrate or potassium chlorate) and a binder (polyurethane, epoxy resin).

It will in this case itself fulfil the function provided by the relay composition tablets 20 described with reference to FIG. 1.

The munition 1 is assembled as follows:

Depending on the case, the cords 8*a* are fastened onto the inner surface of the case 3, or else the cords 8*a* are fastened onto the projectile 2. During this process, the ends of the cords are joined so as to form the strand 9.

The projectile is fastened to the case using suitable means, for example a linking ring such as that described in EP307307.

The case 3 and the cup 22 are then joined together, the latter carrying the tubular part 10 and the ignition unit 25.

Loading with propellant powder is lastly carried out by introducing the grains of powder through the axial opening 24 in the cup 22.

When this operation is completed, the base 5 is fastened onto the cup 22 by means of the nut 30.

One of the advantages of this embodiment lies in that the strand 9 is introduced into the chamber 11 of the tubular part 10 before the introduction of the powder. The strand is therefore certain to be well positioned and can not be displaced by the grains of powder.

Additionally, the grains of powder can not be housed around the strand during loading, since the tubular part delimits a volume around the strand 9.

With this embodiment it is possible for a diameter to be provided for the axial hole 16 that is substantially equal to that of the strand, thereby ensuring its radial support.

By way of a variant, the tubular part 10 and the cup 22 can be advantageously fastened bonded together, or can be made as one part. Such an arrangement will allow the ignition unit 25 to be fastened after the powder has been loaded. Loading operation safety is thereby enhanced.

What is claimed is:

1. A munition having an ignition device , said munition comprising:

a case containing a propellant charge;

a bottom cup portion of the case; and an ignition device comprising:

at least one linear energetic element located substantially along a lengthwise axis of said case; and means for firing said element, the firing means comprising a tubular part located at the bottom cup and delimiting a chamber that communicates with a pyrotechnic igniting component, said tubular part comprising an axial hole extending substantially along the lengthwise axis of said case and communicating with said chamber, said at least one linear energetic element extending from the propellant charge located in the case through the axial hole and into the chamber.

2. The munition having an ignition device according to claim 1, further comprising at least two linear energetic ignition elements, said elements being connected along at least part of their length to form a strand that is located substantially along the case lengthwise axis, through the axial hole, and at least partially inside chamber of the tubular part.

3. The munition having an ignition device according to claim 1, wherein the at least one energetic linear ignition element is attached to an inner cylindrical surface of the case.

4. The munition having an ignition device according to claim 1, further comprising a first fastening means, wherein the cup obturates the bottom of the case, said first fastening means integrally joins the cup with a cylindrical wall of the case, and the tubular part is integral with the cup.

5. The munition having an ignition device according to claim 4, further comprising a base and a second fastening means for integrally joining the cup with the base.

6. The munition having an ignition device according to claim 5, wherein said base is attached to said cup by a threaded fastener.

* * * * *